US009115902B2

(12) United States Patent
Danzer et al.

(10) Patent No.: US 9,115,902 B2
(45) Date of Patent: Aug. 25, 2015

(54) HOUSEHOLD APPLIANCE, IN PARTICULAR OVEN

(75) Inventors: Norbert Danzer, Gebsattel (DE); Arnd Hofmann, Lulsfeld (DE); Abdel-Ilah Zbat, Wurzburg (DE); Martin Gasch, Rothenburg o.d. Tauber (DE)

(73) Assignee: ELECTROLUX HOME PRODUCTS CORPORATION N.V., Brussel (BE)

( * ) Notice: Subject to any disclaimer, the term of this patent is extended or adjusted under 35 U.S.C. 154(b) by 204 days.

(21) Appl. No.: 13/132,970

(22) PCT Filed: Dec. 3, 2009

(86) PCT No.: PCT/EP2009/008610

§ 371 (c)(1),
(2), (4) Date: Jun. 6, 2011

(87) PCT Pub. No.: WO2010/078894

PCT Pub. Date: Jul. 15, 2010

(65) Prior Publication Data

US 2011/0240003 A1 Oct. 6, 2011

(30) Foreign Application Priority Data

Dec. 19, 2008 (EP) ..... 08022119

(51) Int. Cl.
*F24C 15/02* (2006.01)
*F24C 15/04* (2006.01)

(52) U.S. Cl.
CPC *F24C 15/02* (2013.01); *F24C 15/04* (2013.01)

(58) Field of Classification Search
CPC ..... F24C 15/04
USPC ..... 126/200, 190, 198; 362/92, 126, 560, 362/125; 99/341
See application file for complete search history.

(56) References Cited

U.S. PATENT DOCUMENTS 2,250,859 A * 7/1941 Ehret ..... 126/200
2,281,608 A * 5/1942 Vincent ..... 359/736
2,794,434 A * 6/1957 Evans ..... 126/200

(Continued)

FOREIGN PATENT DOCUMENTS

BE 502741 8/1952
CH 687215 A5 * 10/1996 ..... E04D 13/076
DE 1278710 9/1968
DE 20302838 U1 * 6/2003

(Continued)

OTHER PUBLICATIONS

International Search Report for PCT/EP2009/008610, dated May 25, 2011, 3 pages.

*Primary Examiner* — Kenneth Rinehart
*Assistant Examiner* — Gajanan M Prabhu
(74) *Attorney, Agent, or Firm* — Pearne & Gordon LLP

(57) ABSTRACT

Household appliance (10, 40), in particular an oven, comprising a casing (12, 42), which defines a cavity (14, 44) having an opening (16, 46), and a door (18, 48) for opening and closing said opening (16, 46), wherein the door (18, 48) comprises a front wall (20, 50) and a frame (22, 52), wherein the frame (22, 52) comprises at least one window portion (30, 60) made of a transparent material and being visible from outside the appliance (10, 40), and in that an optical deflecting device (32, 62) is provided for projecting an image of the interior of the cavity (14, 44) on the window portion (30, 60).

16 Claims, 1 Drawing Sheet

(56) References Cited

U.S. PATENT DOCUMENTS

Figure 1:
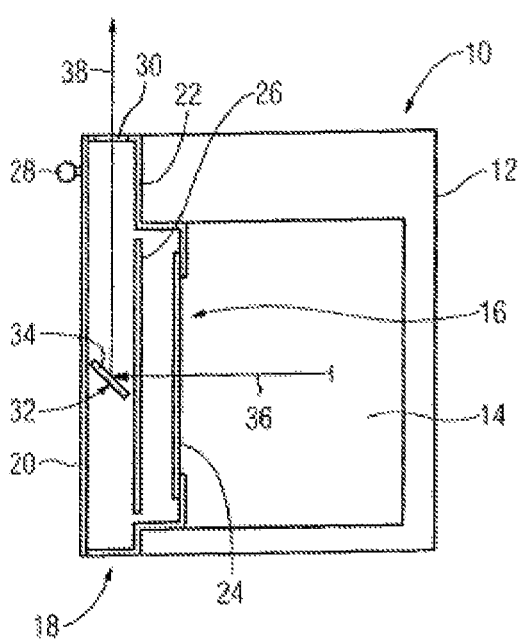

| | | | | |
|---|---|---|---|---|
| 3,623,472 | A * | 11/1971 | Mazza | 126/273 R |
| 4,598,693 | A * | 7/1986 | Koziol | 126/41 R |
| 5,960,785 | A * | 10/1999 | Byrne et al. | 126/200 |
| 6,508,085 | B1 * | 1/2003 | Byrne | 68/3 R |
| 7,157,667 | B2 * | 1/2007 | Gramlich et al. | 219/391 |
| 2009/0064593 | A1 * | 3/2009 | Ha | 49/400 |
| 2009/0194090 | A1 * | 8/2009 | Kim et al. | 126/198 |

FOREIGN PATENT DOCUMENTS

| | | |
|---|---|---|
| DE | 10318859 | 11/2004 |
| DE | 102007048834 | 4/2008 |
| JP | 11173569 | 6/1999 |
| WO | 0231411 | 4/2002 |
| WO | 03081285 | 10/2003 |

* cited by examiner

HOUSEHOLD APPLIANCE, IN PARTICULAR OVEN

TECHNICAL FIELD

The present invention relates to a household appliance, in particular an oven, comprising a casing, which defines a cavity having an opening, and a door for opening and closing said opening, wherein the door comprises a front wall and a frame.

BACKGROUND TECHNOLOGY

Ovens or cooking ovens of the above-mentioned type are already known in many different configurations. The front wall of the door of such ovens is at least partially made of a transparent material, e.g. glass in order to enable a user to observe the interior of the cavity during the operation of the oven i.e. the foodstuff to be cooked. Such ovens often show the problem, that the front wall of the door is getting very hot during operation such that people, in particular children, can hurt themselves when touching it. Moreover, a lot of heat is radiated from the oven door to the surroundings. Accordingly, the energy efficiency is suboptimal. A further problem is met when the oven is positioned at a low installation height. In this case one has to stoop down in order to observe the foodstuff placed within the oven cavity, which is quite uncomfortable for the user.

It is therefore an object of the present invention to provide a household appliance of the above-mentioned kind posing little danger of getting burned, having a good energy efficiency and enabling a user to observe the inside of the cavity in a comfortable manner.

DISCLOSURE OF THE INVENTION

This object is solved in that the frame of a household appliance of the above-mentioned kind comprises at least one window portion made of transparent material being visible from outside the appliance, wherein an optical deflecting device is provided for projecting an image of the interior of the cavity on the window portion.

Accordingly, in contrast to conventional ovens, the front wall of the door does not have to be made of a transparent material, e.g. glass, such that a material with better heat insulating properties may be used. Thus, a good energy efficiency can be achieved. Moreover, when a material with good heat insulating properties is used for the front wall of the door, the danger of getting burned can be eliminated.

If the household appliance is to be installed at a low installation height, the window portion is preferably arranged at an upper portion of the frame such that the user can observe the inside of the cavity without the need to stoop down.

When the household appliance is installed at a higher installation height, the window portion is preferably arranged at a side portion of the frame such that the image of the interior of the cavity is comfortably observable by a user standing next to the household appliance.

The window portion and the frame may be made integral in order to reduce the number of components. Accordingly, the assembly of the household appliance can be simplified.

According to one aspect of the present invention the optical deflecting device comprises a mirror. Such a mirror is an inexpensive means for projecting an image of the interior of the cavity on the window portion. Accordingly, the overall costs of the household appliance can be kept down.

Moreover, the optical deflecting device can comprise a magnification unit for magnifying the image of the interior of the cavity projected on the window portion. Thus, a person can better observe the inside of the cavity.

Preferably, the optical deflecting device is arranged within the door in order to safe installation space. Moreover, the optical deflecting device is less influenced by the heat generated within the oven cavity when installed within the door. Accordingly, the life time of the optical deflecting device can be increased.

Since the inside of the cavity can be observed through the window portion of the frame, the front wall can be non-transparent. Moreover, the front wall can be made of a heat insulating and/or scratch-resistant and/or haptically pleasant material.

BRIEF DESCRIPTION OF THE ACCOMPANYING DRAWINGS

Further features and advantages of the present invention will become apparent from the following description of embodiments of the present invention with reference to the accompanying drawing. In the drawing FIG. 1 is a cross-sectional side view of a household appliance according to a first embodiment of the present invention; and FIG. 2 is a cross-sectional side view of a household appliance according to a second embodiment of the present invention.

Figure 2:
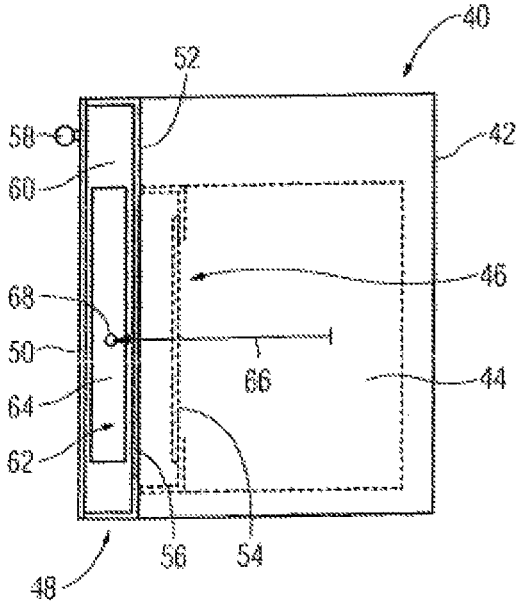

FIG. 1 shows a household appliance 10 in the form of a cooking oven according to a first embodiment of the present invention. The oven 10 comprises a casing 12, which defines a cavity 14 for receiving foodstuff to be cooked therein. The cavity 14 has an opening 16, which can be opened and closed by means of a door 18. The door 18 comprises a front wall 20 and a frame 22, to which the front wall 20 is fixed. Moreover, the door 18 comprises a transparent inner glass 24 and a transparent center glass 26 supported by the frame 22. For opening and closing the door 18, which is pivotally fixed to the casing 12 by means of hinges (not shown), a grip 28 is attached from the outside to the upper portion of the front wall 20.

The front wall 20 is made of a heat insulating, scratch-resistent and haptically pleasant non-transparent material. In order to enable a user of the oven 10 to observe the interior of the cavity 14 during the operation of the oven 10, i.e. the food stuff placed therein, an upper portion of the frame 22, which is visible from outside the appliance 10, is integrally provided with a transparent window portion 30. Moreover, an optical deflecting device 32, which comprises a mirror 34, is arranged in the spacing between the front wall 20 and the center glass 26 in such a manner, that an image of the interior of the cavity 14 is projected on the window portion 30. Accordingly, one can observe the interior of the cavity 14 by looking at the window portion 30 from above, as it is indicated by arrows 36 and 38.

The arrangement shown in FIG. 1 is advantageous in that a user does not have to stoop down for observing the interior of the cavity 14 when the oven 10 is arranged at a low installation height. Due to the provision of the window portion 30 and the optical deflecting device 32 the front wall 20 of the door 18 does not have to be made of a transparent material, e.g. glass. Accordingly, a material with good heat insulating properties can be chosen for the front wall 20 in order to achieve a good energy efficiency. Moreover, the danger of getting burned can be eliminated by an appropriate choice of the front wall material.

FIG. 2 shows a household appliance 40 in the form of an oven according to a second embodiment of the present invention. The household appliance 40 comprises a casing 42, which defines the cavity 44 for receiving foodstuff to be cooked therein. The cavity 44 has an opening 46, which can be opened and closed by means of a door 48. The door 48 comprises a front wall 50 and a frame 52, to which the front wall 48 is fixed. Moreover, the door 48 comprises a transparent inner glass 54 and a transparent center glass 56 supported by the frame 52. For opening and closing the door 48, which is pivotally fixed to the casing 42, a grip 58 is attached from the outside to the upper portion of the front wall 50.

The front wall 50 is made of a heat insulating, scratch-resistant and haptically pleasant non-transparent material. In order to enable a user of the oven 40 to observe the interior of the cavity 44, a side portion of the frame 52, which is visible from outside the appliance 10, is provided with a transparent window portion 60. Moreover, an optical deflecting device 62, which comprises a magnifying mirror 64, is arranged in the spacing between the front wall 50 and the center glass 56 in such a manner, that an image of the interior of the cavity 44 is projected on the window portion 60 in enlarged scale. Accordingly, one can observe the interior of the cavity 44 by looking at the window portion 60 from the side, as it is indicated by arrows 66 and 68.

The provision of the window portion 60 at a side portion of the frame 52 is advantageous at the time when the oven 40 is installed on eye level. Moreover, the household appliance 40 shows the same advantages with respect to the energy efficiency and the elimination of the danger of getting burned as the household appliance 10 shown in FIG. 1.

The invention claimed is:

1. A household appliance comprising a casing, which defines a cavity having an opening, and a door for opening and closing said opening, wherein the door comprises a front wall and a frame, wherein the frame comprises at least one window portion made of a transparent material and being visible from outside the appliance, and wherein an optical deflecting device is provided for projecting an image of the interior of the cavity on the window portion, wherein the optical deflecting device extends along a majority of the opening, wherein the window portion is arranged at a vertical side portion of the frame, and wherein the window portion extends along a majority of the opening.

2. The household appliance according to claim 1, wherein the window portion and the frame are integral.

3. The household appliance according to claim 1, wherein the optical deflecting device comprises a mirror, and wherein the mirror extends along a majority of the opening.

4. The household appliance according to claim 1, wherein the optical deflecting device comprises a magnification unit for magnifying the image projected on the window portion, and wherein the magnification unit extends along a majority of the opening.

5. The household appliance according to claim 1, wherein the optical deflecting device comprises a magnifying mirror, and wherein the magnifying mirror extends along a majority of the opening.

6. The household appliance according to claim 1, wherein the front wall is non-transparent.

7. The household appliance according to claim 6, wherein the front wall comprises a heat insulating and/or scratch-resistant material.

8. The household appliance according to claim 1, wherein the door further comprises a transparent inner glass and a transparent center glass, wherein the transparent inner glass is arranged closest to the opening and wherein the transparent center glass is arranged between the front wall and the transparent inner glass.

9. The household appliance according to claim 8, wherein the optical deflecting device is arranged in a spacing of the door defined between the front wall and the transparent center glass.

10. The household appliance according to claim 9, wherein the transparent inner glass and the transparent center glass extend along a majority of the opening.

11. The household appliance according to claim 1, wherein the image of the interior of the cavity is projected on the window portion along a first substantially linear path defined from the interior of the cavity to the optical deflecting device and a second substantially linear path defined from the optical deflecting device to the window portion.

12. The household appliance according to claim 11, wherein the second substantially linear path is unobstructed.

13. A household appliance comprising a casing, which defines a cavity having an opening, and a door for opening and closing said opening, wherein the door comprises a front wall, a transparent inner glass, a transparent center glass, and a frame, wherein the frame comprises at least one window portion made of a transparent material and being visible from outside the appliance, wherein the window portion is arranged at a vertical side portion of the frame, and wherein an optical deflecting device is provided for projecting an image of the interior of the cavity on the window portion, wherein the transparent inner glass is arranged closest to the opening and the transparent center glass is arranged between the front wall and the transparent inner glass, wherein the optical deflecting device is arranged in a spacing of the door defined between the front wall and the transparent center glass, and wherein the optical deflecting device, the window portion, the transparent center glass, and the transparent inner glass extend along a majority of the opening.

14. The household appliance according to claim 13, wherein the image of the interior of the cavity is projected on the window portion along a first substantially linear path defined from the interior of the cavity to the optical deflecting device and a second substantially linear path defined from the optical deflecting device to the window portion.

15. The household appliance according to claim 14, wherein the transparent inner glass and the transparent center glass are arranged in the first substantially linear path.

16. The household appliance according to claim 14, wherein the second substantially linear path is unobstructed.

* * * * *